United States Patent [19]

Derks et al.

[11] 4,319,159

[45] Mar. 9, 1982

[54] CAMERA TUBE SELENIUM TARGET INCLUDING ARSENIC INCREASING IN CONCENTRATION FROM RADIATION SIDE

[75] Inventors: Petrus J. A. M. Derks; Joannes H. J. van Dommelen; Jan Dieleman, all of Eindhoven, Netherlands

[73] Assignee: U.S. Philips Corporation, New York, N.Y.

[21] Appl. No.: 39,537

[22] Filed: May 16, 1979

[30] Foreign Application Priority Data

May 19, 1978 [NL] Netherlands ..... 7805418

[51] Int. Cl.[3] ..... H01J 29/45; H01J 31/38

[52] U.S. Cl. ..... 313/386; 313/94

[58] Field of Search ..... 313/386, 385, 384

[56] References Cited

U.S. PATENT DOCUMENTS

| | | | |
|---|---|---|---|
| 3,890,525 | 6/1975 | Hirai et al. | 313/386 |
| 4,007,395 | 2/1977 | Nonaka et al. | 313/386 |
| 4,040,985 | 8/1977 | Shidara et al. | 313/386 X |

*Primary Examiner*—Robert Segal

*Attorney, Agent, or Firm*—Marc D. Schechter

[57] ABSTRACT

A camera tube having an electron source and a target to be scanned on one side by an electron beam emanating from said source. Radiation forming the image to be detected is incident on the other side of the target. The target comprises a signal electrode and a selenium-containing vitreous layer containing arsenic. The arsenic concentration in the selenium-containing layer increases continuously from the radiation-receiving side of the layer to the side which is scanned by the electron beam. The signal electrode is on the radiation-receiving side of the layer and thus on the radiation-receiving side of the target.

8 Claims, 2 Drawing Figures

CAMERA TUBE SELENIUM TARGET INCLUDING ARSENIC INCREASING IN CONCENTRATION FROM RADIATION SIDE

BACKGROUND OF THE INVENTION

The invention relates to a camera tube having an electron source and a target to be scanned on one side by an electron beam emanating from the source. The opposite side of the target is illuminated with radiation forming the image to be detected. The target comprises a signal electrode and a selenium-containing vitreous layer containing arsenic. The signal electrode is on the radiation-receiving side of the target and the vitreous layer is on the side to be scanned by electrons.

A camera tube of the kind described above is known, for example, from British Patent Specification No. 1,135,460.

In practice, glass-stabilizing additions to selenium-containing vitreous photosensitive layers, for example arsenic, are desired so as to control the deterioration of the properties of the layers as a result of crystallization phenomena.

In addition, it is of importance, inter alia, to assure a good operation of the camera tube, that there should be good blocking against the injection of holes from the signal electrode into the selenium-containing layer so as to keep the dark current and the lag low. However, the dark current and the lag may be considerable if glass-stabilizing additions are used in high concentrations.

In low concentrations of these additions, an annoyingly high operating voltage may be necessary and a moderate sensitivity, in particular to light of long wavelength may occur.

The selenium-containing layer with additions may be separated from the signal electrode by a vitreous layer of pure selenium so that good blocking is obtained between the signal electrode and the selenium-containing layer with additions. The disadvantage of this solution, however, is that as a result of the use of a layer of pure selenium the glass stability is reduced and the lag is increased.

SUMMARY OF THE INVENTION

One of the object of the invention is to at least considerably avoid the above-mentioned problems and to provide an optimally operating camera tube.

The invention is, inter alia, based on the discovery that a good combination of properties is obtained if the concentration of the arsenic addition to the photosensitive selenium-containing layer is not constant.

Therefore, according to the invention, the camera tube described above is characterized in that the arsenic concentration in the selenium-containing layer increases continuously from the radiation-receiving side of the layer to the side of the layer which is scanned by the electron beam.

According to the present invention, the increase in the arsenic concentration is to be understood to mean that the arsenic concentration on the scanned side of the selenium-containing layer is at least 10% larger than the arsenic concentration on the radiation-receiving side.

It has been found that with a continuous increase in the arsenic concentration the properties of the camera tube are improved considerably as compared to a stepwise increase in the arsenic concentration.

In addition to good glass stabilization of the photosensitive layer, a low lag and dark current at a reasonable operating voltage are obtained.

Good properties are obtained in particular if the arsenic concentration on the radiation-receiving side of the layer is at most 13 atomic %.

An important improvement in the glass stability is obtained if the arsenic concentration on the radiation-receiving side of the layer is only $1\frac{1}{2}$ atomic, % or greater.

Other properties, for example the sensitivity to radiation of long wavelength and the operating voltage, are favorably influenced by a rapid increase of the arsenic concentration at the radiation-receiving side of the layer.

Therefore, the variation of the arsenic concentration in the selenium-containing layer should preferably show a negative curvature and said variation should be steepest at the radiation-receiving side (i.e. the rate of change of the arsenic concentration as a function of distance from the radiation-receiving side of the layer is decreasing throughout the layer).

The sensitivity to radiation of long wavelength is further improved when the selenium-containing layer has a sensitivity-improving addition, preferably belonging to the group consisting of cadmium, antimony, tellurium and iodine.

A particularly suitable sensitivity-improving addition is tellurium in a concentration, on the radiation-receiving side of the layer, less than 7 atomic % and when the sum of the concentrations of tellurium and arsenic on the radiation-receiving side is less than 13 atomic %.

The invention will now be described in greater detail with reference to a few examples and the accompanying drawing.

DESCRIPTION OF THE PREFERRED EMBODIMENTS

Figure 1:
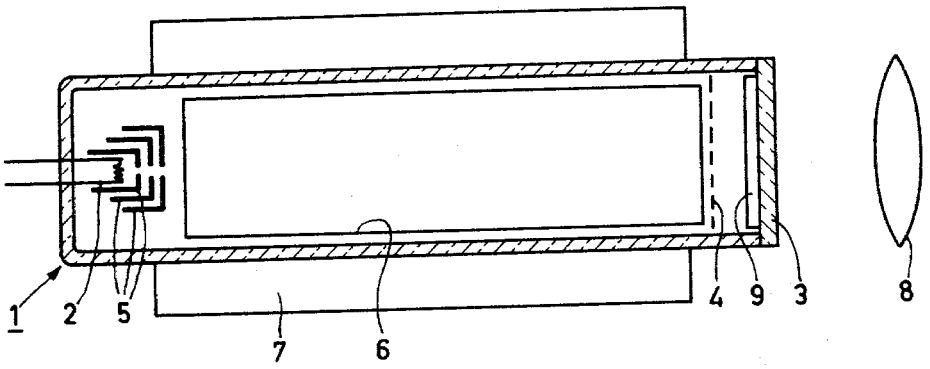
FIG. 1 shows diagrammatically a camera tube according to the invention.

The camera tube 1, shown in FIG. 1, has an electron source 2 and a target 9 (see also FIG. 2) to be scanned on one side by an electron beam 20 emanating from the source 2. On another side of target 9, radiation 24 is incident on the target. Signal electrode 22 and a selenium-containing vitreous layer 21 make up target 9. Electrode 22 is on the radiation-receiving side of the target and vitreous layer 21 is on the scanned side of the target. Radiation 24 passes through electrode 22 to reach the radiation-receiving side of layer 21. The layer 21 contains arsenic.

According to the invention the arsenic concentration in the selenium-containing layer 21 increases continuously from the radiation-receiving side of the layer to the side 9 which is scanned by the electron beam 20.

The camera tube comprises, in the usual manner, electrodes 5 to accelerate electrons and to focus the electron beam. Furthermore, conventional means are present to deflect the electron beam so that the target 9 can be scanned. These means are, for example, a set of coils 7. The electrode 6, inter alia, serves to screen the wall of the tube from the electron beam. An image scene to be picked up is projected on the target 9 by means of the lens 8, the window 3 being permeable to the incident radiation.

Furthermore, a collector grid 4 is present in the usual manner. By means of this grid which, for example, may alternatively be an annular electrode, reflected and secondary electrons coming from the target 9 may be dissipated.

Figure 2:
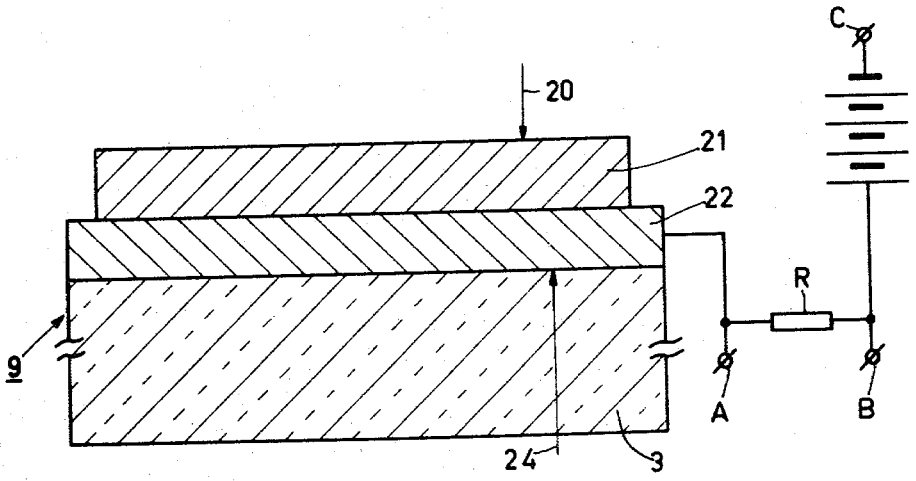
FIG. 2 is a diagrammatic sectional view of a target for a camera tube according to the invention.

During operation the signal electrode 22 is biased positively with respect to the electron source 2. In FIG. 2 the electron source is to be connected to the point C. Upon scanning by the electron beam 20 of the target, the target is charged to substantially the cathode potential.

The target is then discharged fully or partly depending on the intensity of the radiation 24 impinging on the selenium-containing layer 21. In a subsequent scanning cycle, charge is supplied again until the target has again assumed the cathode potential. The charging current is a measure of the intensity of the radiation 24. Output signals are derived from the terminals A and B via the resistor R.

EXAMPLE I

Arsenic, selenium and tellurium, in quantities corresponding to 20 atomic % As, 72 atomic % Se and 8 atomic % Te, are placed in a silica ampule. The ampule is evacuated to $10^{-6}$ mm Hg, sealed, and placed in a furnace which makes a rocking movement.

The furnace may be heated to 500° C. and kept at this temperature for 90 minutes. Better results can be obtained however by heating the furnace to higher temperatures, e.g. 850° C., for, e.g. 75 hours. The glass melt formed is then cooled rapidly.

Glass disks 3 (FIG. 2) are coated on one large side with a 0.1 μm thick layer of tin oxide forming the signal electrode 22. The tin oxide layer is coated with a 0.05 μm thick cadmium selenide layer (not shown) at a pressure of $10^{-6}$ mm Hg. Such a CdSe layer slightly increases the sensitivity to long wavelength radiation. Vapor deposition of CdSe is carried out by means of a resistance-heated molybdenum holder with a silica insert in which the CdSe is present. The source temperature is 870° C. and the deposition rate is $10^{-3}$ μm/sec at a substrate temperature of 200° C.

The substrates thus obtained are placed in a second vacuum vapor deposition device above a resistance heated molybdenum holder having a silica insert and a silica diaphragm. The silica insert is filled with 1.25 grams of the synthesized As-Se-Te glass mixture, after which the vapor deposition device is evacuated to $10^{-6}$ mm Hg.

The substrates are then heated and kept at a constant temperature of approximately 60° C., the vapor deposition source (As-Se-Te glass mixture) being heated to approximately 420° C. During the heating, a flap is present above the diaphragm of the source. The flap is opened when the desired source temperature is reached, after which a 2 μm thick amorphous selenium-containing layer 21 of arsenic, selenium and tellurium is deposited on the substrates at constant temperature and in approximately 3½ minutes. The flap is then closed and the source is cooled, the substrates being kept at approximately 60° C. for approximately another 20 minutes after which they are cooled and removed from the vapor deposition device.

One of the substrates thus obtained is mounted on a television camera tube and a second substrate is analysed by means of secondary ion mass spectrometry.

From the chemical analysis it appears that in the vapor deposited selenium-containing layer a concentration gradient of arsenic and of selenium is present. Viewed from the radiation-receiving side of the layer the arsenic concentration increases from approximately 6 to approximately 22 atomic %, while the selenium concentration decreases from approximately 89 to approximately 72 atomic % and the tellurium concentration increases only very little, namely, from approximately 5 to approximately 6 atomic %.

The arsenic concentration at the radiation-receiving side of the layer is thus greater than 1½ and less than 13 atomic %. The concentration of the sensitivity-improving tellurium is less than 7 atomic % and the sum of the arsenic and tellurium concentrations on the radiation-receiving side of the layer is also less than 13 atomic %.

In addition it was found that the variation of the arsenic concentration in the selenium-containing layer shows a negative curvature and is steepest at the radiation-receiving side.

The substrate mounted on the camera tube was evaluated at various signal electrode voltages for the light response rate, spectral distribution of the sensitivity, permanent after-images, dark current, light transfer characteristic, picture quality and resolving power.

The camera tube was then kept at 60° C. for 520 hours under operating conditions (with light and voltage on the target), then cooled to ambient temperature, and again evaluated for its above-mentioned photoelectric properties.

Both before and after the temperature treatment, the properties measured at optimum signal electrode voltage (approximately 30 V) are very satisfactory, while no noteworthy change in the properties has arisen.

Optimum voltage is to be understood to mean herein the maximum permissible voltage between signal electrode and electron source at which the properties characteristic of too high a signal electrode voltage do not yet occur. The properties are, for example, too high a dark current (more than a few nA/cm$^2$), the beginning of noticeable local differences in dark current, and/or the persistence of positive after-images.

EXAMPLE II

Arsenic, selenium and tellurium are weighed out in a silica ampule in quantities corresponding to 10 atomic % As, 85 atomic % Se and 5 atomic % Te.

The evacuated ampule is maintained at 850° C. in a rocking furnace for 75 hours. After rapidly cooling the ampoule in water, the synthesized glass mixture is used as a source material.

In a vacuum vapor deposition device a few substrates, consisting of glass disks provided on one large side with a signal electrode layer 22 of tin-doped indium oxide, are placed with the electrode layer facing a stainless steel vapor deposition furnace coated with a silicon nitride layer. The layer and the furnace are separated by a distance of 20 cm.

4 grams of the synthesized glass mixture are introduced into the vapor deposition furnace, the vapor deposition device is evacuated to $10^{-6}$ mm, and the furnace is heated to approximately 340° C. While the temperature remains constant, a flap between the furnace and the substrate screening the latter from released vapours. After 20 minutes the flap is opened for 15 minutes and a 3 μm thick amorphous photoconductive selenium-containing layer 21 is deposited on the substrates.

The flap is then closed in such manner that vapor is deposited only on one half of one of the substrates for 10 minutes so that the selenium-containing layer 21 at that area becomes 5 μm thick.

X-ray fluorescent analysis of the deposited layers has demonstrated that the arsenic concentration in the 3 μm thick layer increases from the radiation-receiving side of the layer from approximately 5 to approximately 7 atomic %. The selenium concentration decreases from approximately 90.5 to approximately 88 atomic % and the tellurium concentration increases from approximately 4.5 to approximately 5 atomic %. For the 5 μm thick layer the concentrations at the scanned side of the layer are approximately 8 atomic % As, approximately 86.5 atomic % Se and approximately 5.5 atomic % Te.

As in the preceding example, the photoelectric properties are measured after assembling the substrate on a camera tube and operating the tube at the optimum signal electrode voltage, which for the 3 μm thick layer is approximately 35 V and for the 5 μm thick layer is approximately 40 V.

Accordingly, different layer thicknesses on one substrate could be examined due to the fact that the area required for investigation, namely a few $mm^2$, is considerably smaller than the overall substrate surface area, namely approximately 1 $cm^2$.

In this example the same good properties are observed as in the preceding example, although with the difference that targets made according to the second example are less sensitive to red light than those made according to the first example.

The invention is not restricted to the examples described. Within the scope of the invention several variations are possible to those skilled in the art.

In order to improve the sensitivity, cadmium, antimony and iodine may be added in addition to tellurium.

In order to suppress secondary electron emission by and/or electron injection into the selenium-containing layer, a layer of, for example, antimony trisulphide may be provided on the selenium-containing layer on the side to be scanned.

Instead of the above-described cadmium selenide layer, other thin layers, for example of gallium-sulphide glass or molybdenum trioxide ($MoO_3$), may be provided between the signal electrode and the selenium-containing layer.

Also, phosphorus and/or germanium may be combined with arsenic for use as a glass stabilizing addition.

What is claimed is:

1. A camera tube for detecting a radiation image comprising an electron source and a target having two sides, one side of said target being scanned, in operation, by an electron beam emanating from said source, the other side of said target being irradiated, in operation, by the radiation image to be detected, said target comprising a signal electrode and a selenium-containing vitreous layer having two sides, one side of said layer being scanned, in operation, by an electron beam emanating from said source, the other side of said target being irradiated, in operation, by the radiation image to be detected said signal electrode being provided on the radiation-receiving side of the layer, characterized in that the selenium containing vitreous layer further comprises arsenic in a connection which increases continuously from the radiation-receiving side of the layer to the scanned side of the layer, the arsenic concentration at the radiation-receiving side of the layer being less than or equal to 13 atomic % but greater than or equal to 1.5 atomic %.

2. A camera tube as claimed in claim 1, characterized in that the rate of change of the arsenic concentration as a function of the distance from the radiation-receiving side of the layer is decreasing throughout the layer.

3. A camera tube as claimed in claim 1 or 2, characterized in that the selenium-containing layer further comprises a sensitivity-improving addition from the group consisting of cadmium, antimony, tellurium and iodine.

4. A camera tube as claimed in claim 3, characterized in that the sensitivity-improving addition is tellurium in a concentration at the radiation-receiving side of the layer which is less than 7 atomic %, and the sum of the concentrations of tellurium and arsenic at the radiation-receiving side of the layer is less than 13 atomic %.

5. A photosensitive target comprising:

a vitreous layer comprising selenium and arsenic, said layer having a first side and a second side; and a signal electrode on the first side of the layer;

characterized in that the arsenic concentration in the layer increases continuously from the first side to the second side, the arsenic concentration at the first side of the layer being less than or equal to 13 atomic percent but greater than or equal to 1.5 atomic percent.

6. A photosensitive target as claimed in claim 5, characterized in that the rate of change of the arsenic concentration as a function of the distance from the first side of the layer is decreasing throughout the layer.

7. A photosensitive target as claimed in claim 5 or 6, characterized in that the vitreous layer further comprises a sensitivity-improving addition from the group consisting of cadium, antimony, tellurium and iodine.

8. A photosensitive target as claimed in claim 7, characterized in that the sensitivity-improving addition is tellurium in a concentration at the first side of the layer which is less than 7 atomic percent, and the sum of the concentrations of tellurium and arsenic at the first side of the layer is less than 13 atomic percent.

* * * * *